US011635270B2

(12) United States Patent
Dextraze

(10) Patent No.: US 11,635,270 B2
(45) Date of Patent: Apr. 25, 2023

(54) SINGLE-STAGE AND TWO-STAGE TRIGGER MECHANISM FOR A FIREARM

(71) Applicant: CADEQUIP, INC., St-Jean-sur-Richelieu (CA)

(72) Inventor: Serge Dextraze, St-Jean-sur-Richelieu (CA)

(73) Assignee: CADEQUIP, INC., St-Jean-sur-Richelieu (CA)

( * ) Notice: Subject to any disclaimer, the term of this patent is extended or adjusted under 35 U.S.C. 154(b) by 163 days.

(21) Appl. No.: 17/150,577

(22) Filed: Jan. 15, 2021

(65) Prior Publication Data

US 2021/0278157 A1 Sep. 9, 2021

Related U.S. Application Data

(60) Provisional application No. 62/962,464, filed on Jan. 17, 2020.

(51) Int. Cl.
*F41A 19/16* (2006.01)
*F41A 19/12* (2006.01)

(52) U.S. Cl.
CPC ..... *F41A 19/16* (2013.01); *F41A 19/12* (2013.01)

(58) Field of Classification Search
CPC ..... F41A 19/10; F41A 19/12; F41A 19/15; F41A 19/16; F41A 19/17
See application file for complete search history.

(56) References Cited

U.S. PATENT DOCUMENTS

| | | | | | |
|---|---|---|---|---|---|
| 3,950,876 | A * | 4/1976 | Wild | F41A 19/32 | 42/69.01 |
| 5,487,233 | A * | 1/1996 | Jewell | F41A 19/16 | 42/69.01 |
| 9,267,750 | B1 * | 2/2016 | Tubb | F41A 17/56 | |
| 10,578,385 | B2 * | 3/2020 | Dextraze | F41A 19/10 | |
| 10,704,853 | B2 * | 7/2020 | Geissele | F41A 19/10 | |
| 10,809,030 | B2 * | 10/2020 | Geissele | F41A 19/10 | |
| 11,199,373 | B1 * | 12/2021 | Watkins | F41A 19/12 | |
| 11,274,893 | B1 * | 3/2022 | Kras | F41A 19/10 | |
| 11,359,878 | B2 * | 6/2022 | Moretti | F41A 17/52 | |
| 11,391,530 | B2 * | 7/2022 | Tubb | F41A 17/64 | |

* cited by examiner

*Primary Examiner* — Joshua E Freeman
(74) *Attorney, Agent, or Firm* — Norton Rose Fulbright Canada LLP

(57) ABSTRACT

A trigger mechanism including a top sear for engaging a cocking piece, a transfer arm for engaging the top sear, and a safety lever and second stage sear which engages the transfer arm. The safety lever prevents unintentional firing of a firearm with the trigger mechanism. A bottom sear cooperates with the safety lever and the second stage sear. A reset spring biases the transfer arm. A single stage operation involves both a first stage spring and second stage spring upon trigger load application. In a two-stage operation, the first stage spring is engaged and then the second stage spring is also engaged. A selector pin provides flexibility to alter the mode of operation of the trigger mechanism between single stage trigger operation and a double stage trigger operation.

27 Claims, 10 Drawing Sheets

SINGLE-STAGE AND TWO-STAGE TRIGGER MECHANISM FOR A FIREARM

CROSS REFERENCE TO RELATED APPLICATION

This application claims priority to U.S. Provisional Application Ser. No. 62/962,464 filed Jan. 17, 2020, the disclosure of which is hereby incorporated by reference.

FIELD OF THE INVENTION

The present invention is directed to a trigger mechanism. More specifically, the invention is directed to a trigger mechanism with advanced safety features and a trigger mechanism which facilitates both a single-stage and two-stage trigger pull.

BACKGROUND OF THE INVENTION

The invention is suited, for example, for use in a bolt action rifle, but with minor physical modifications could be more widely usable. Triggers now in use are designed for either single-stage or two-stage operation and are limited to narrow ranges of trigger pull weights and travel. Design geometry on these devices require removal of the receiver from the stock or the trigger from the receiver to affect significant changes in the weight, pull or travel. Moreover, designs now in use do not facilitate a trigger mechanism which selectively provides for both a single-stage and two-stage trigger.

Every user of a firearm, such as a rifle, for highly accurate target or hunting purposes has a preferred trigger pull. Substantially all known trigger mechanisms have a spring bias imparted to the trigger to resist the pulling movement of the operator. The adjustment of the compression or tension forces in the spring opposing the movement of the trigger will provide an adjustment in resisting force of the trigger to the pulling action. Some shooters prefer what is known as a two-stage pull. In the first stage, the trigger moves against a pre-selected spring resistance to a position just short of that required to release the sear and effect the firing of the firearm. At the end of the first stage pull, the trigger encounters additional resistance which indicates to the operator that it is ready for firing with minimum additional trigger travel. The extent of such first stage pull and the amount of additional resistance imparted to the trigger upon entering the second stage is a matter of choice of the firearm operator. The two stage approach provides a level of safety without the use of a traditional safety mechanism.

Moreover, trigger mechanisms now in use are designed with only a single-stage pull or only a two-stage pull. These prior trigger mechanisms do not necessarily achieve a wide range of user choice with respect to trigger weight, pull and/or travel. And some facilitate a variation in trigger weight or pull or travel but do not provide variation in each feature, much less one that provides for both a single-stage and two-stage pull.

SUMMARY OF THE INVENTION

It is, therefore, advantageous to provide a trigger mechanism with improved safety features to prevent unintentional firing of the firearm, such as when the firearm is cocked, and the firearm is dropped. It is also advantageous to provide a single trigger mechanism which facilitates both a single-stage and two-stage trigger mechanism for accommodate different users of a firearm, changing user preferences, changing circumstances, etc.

The present invention overcomes shortcomings of the prior art by providing a novel trigger mechanism for a firearm. In one aspect, the trigger member comprises a top sear for engaging a cocking piece, a transfer arm for engaging the top sear, and a safety lever and second stage sear which engage the transfer arm. A bottom sear cooperates with the safety lever and the second stage sear. A reset spring biases the transfer arm. A single stage operation involves both a first stage spring and second stage spring upon trigger load application. In a two-stage operation, the first stage spring is engaged and then the second stage spring is also engaged. A selector pin provides flexibility to alter the mode of operation of the trigger mechanism.

Related methods of operation are also provided. Other apparatuses, methods, systems, features, and advantages of the multi-stage trigger mechanism will be or become apparent to one with skill in the art upon examination of the following figures and detailed description. It is intended that all such additional apparatuses, methods, systems, features, and advantages be included within this description, be within the scope of the multi-stage trigger mechanism and be protected by the accompanying claims.

DETAILED DESCRIPTION OF THE INVENTION

Figure 1:
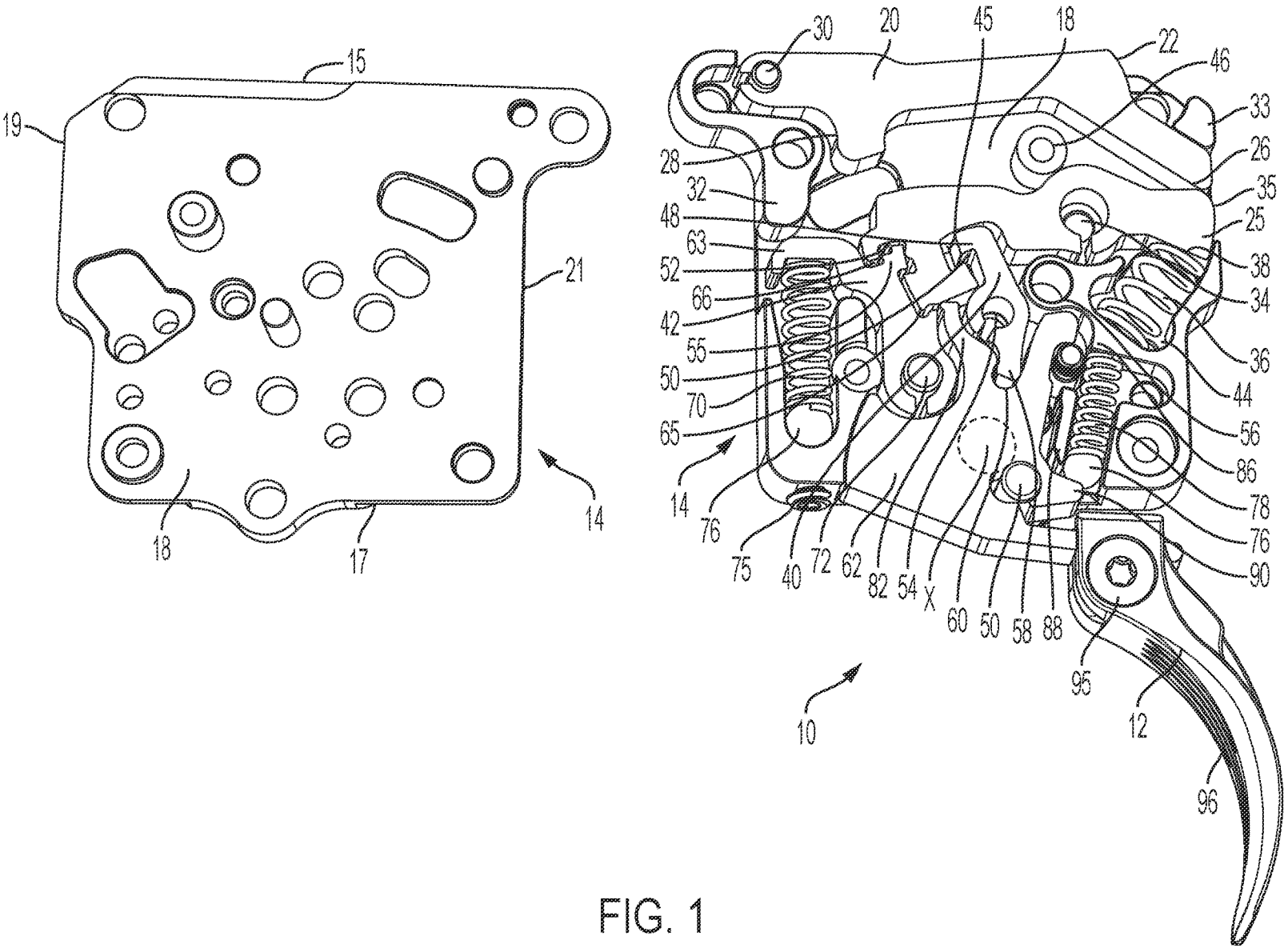
FIG. 1 is a perspective view of the trigger mechanism of the present invention.

The present invention can be understood more readily by reference to the following detailed description, examples, and claims, and their previous and following description. Before the present system, devices, and/or methods are disclosed and described, it is to be understood that this invention is not limited to the specific systems, devices, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known aspect. Those skilled in the relevant art will recognize that many changes can be made to the aspects described, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used herein, the singular forms "a," "an" and "the" include plural referents unless the context clearly dictates otherwise. Thus, for example, reference to a "bolt" includes aspects having two or more bolts unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" and "select" or "selectively" mean that the subsequently described event or circumstance may or may not occur, and that the description includes instances where said event or circumstance occurs and instances where it does not.

Terms used herein, such as "exemplary" or "exemplified," are not meant to show preference, but rather to explain that the aspect discussed thereafter is merely one example of the aspect presented.

Additionally, as used herein, relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Figure 2:
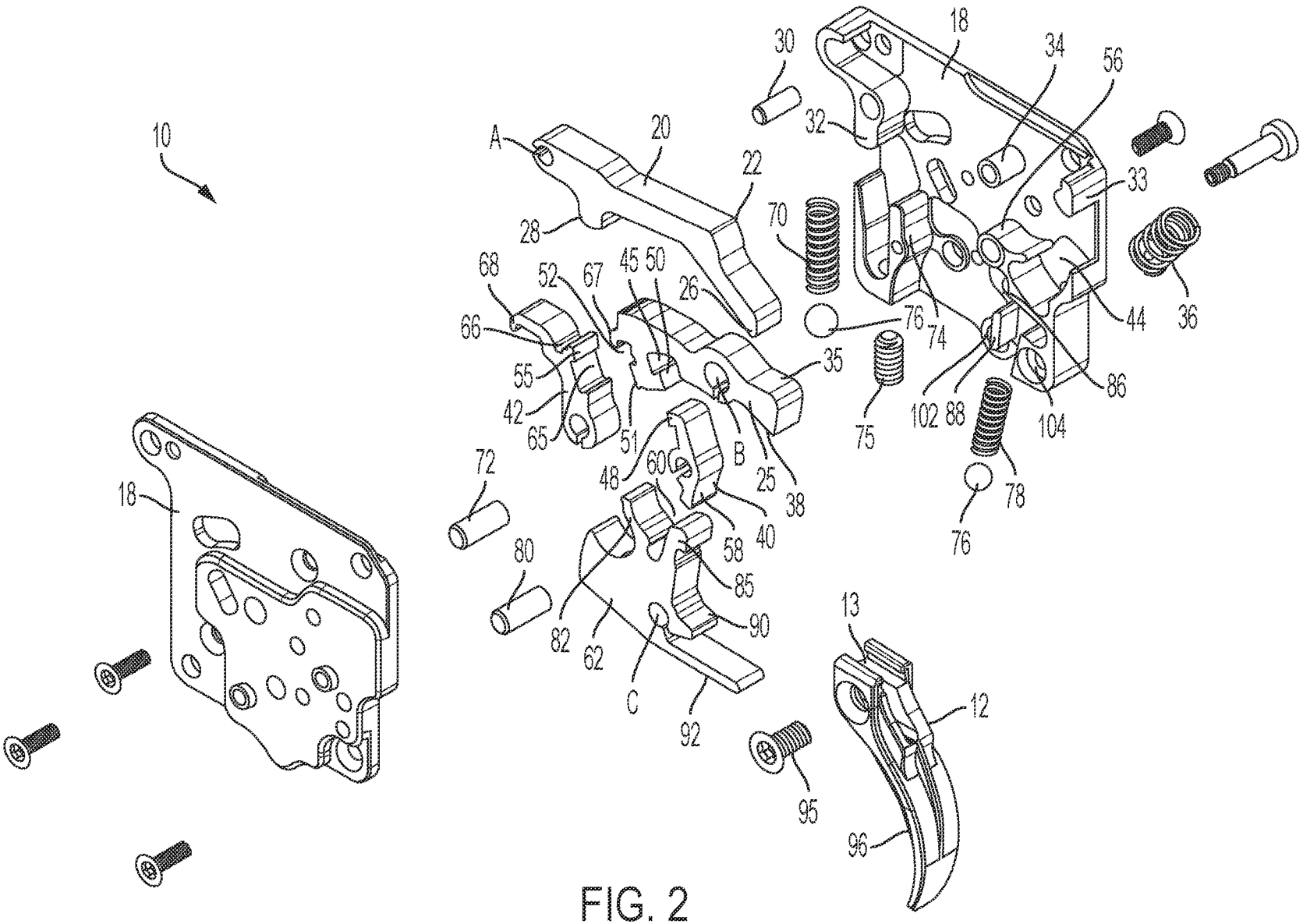
FIG. 2 is an exploded view thereof.

In one aspect, presented herein is trigger mechanism 10 for a firearm. In one aspect, the trigger mechanism 10 is used in a firearm that is a bolt action rifle having a frame, a barrel attached to the frame, a firing mechanism and the trigger mechanism 10 operatively interacting with a trigger 12 and the firing mechanism. The firing mechanism includes a cocking piece 16 shown in FIG. 3. In one aspect, the trigger mechanism 10 comprises a trigger housing 14 having a top 15, bottom 17, front 19 (firing direction) and back 21 (firearm user). This nomenclature (top, bottom, front and back) is used to describe other trigger mechanism members. The trigger housing 14 comprises spaced apart fore and aft plate elements 18 mountable below the firing mechanism and cocking piece 16. The trigger mechanism 10 is thus positioned between the fore and aft plate elements 18 as shown in FIG. 2.

The trigger mechanism 10 includes a top sear 20 operatively connected to a respective plate element 18 as shown in FIG. 1. The top sear 20 has a predetermined configuration and mass and extends generally across the plate element 18 adjacent the top 15 thereof. The top sear 20 is configured so as to define various contact points including a first, top contact point 22 for blocking the passage of a firing pin (not shown) through the firing pin travel path. The top sear 20 defines a second, back contact point 26, for contacting the transfer arm 25. The top sear 20 also defines a third contact point or top sear stop 28 shown in the form of a flange configured to limit rotation of the top sear 20. The top sear 20 is pivotally connected to the plate element 18 with a pin 30 about which the top sear 20 rotates. Rotation of the top sear 20 is limited by a plate element stop 32 which limits clockwise rotation of the top sear 20 a predetermined radius when the top sear 28 contacts the plate element stop 32 as shown in the various Figures. A back stop 33 is defined by the plate element 18 on an inwardly facing surface so as to provide a stop 33 for counterclockwise rotation of the top sear 28 beyond a predetermined radius wherein the back end of the top sear 28, along its top surface, abuts the stop 33.

The transfer arm 25 is positioned beneath the top sear 20 and has a predetermined configuration and mass to cooperate with adjacent members. The transfer arm 25 is operatively connected to the plate element 18 and rotates about a pin 34, which, for example, is defined by a protrusion extending from the plate element 18 as shown in FIG. 2. The transfer arm 25 defines a plurality of contact points including a first, back contact point 35 for operatively engaging the back contact 26 of the top sear 20 as explained below. The transfer arm 25 defines a second, bottom contact 38 configured and positioned to contact a reset spring 36 for engaging the second bottom contact 38 and for biasing the transfer arm in a counterclockwise direction about the pivot location of pin 34.

The reset spring 36 is received within a channel 44 defined by an inwardly facing surface of the plate element 18. The reset spring 36 comprises predetermined coil dimensions to provide predetermined forces, generally upward in the direction of the top 15 of the base element 18, so as to exert generally upward forces onto the transfer arm bottom contact 38, biasing it in a counter-clockwise rotation direction. The reset spring 36, in the absence of compression forces, exerts pressure to the transfer arm 25 in a counterclockwise direction (about pin 34) wherein the back contact 35 of the transfer arm 25 contacts the back contact 26 of the top sear 20 as explained more fully below.

The front portion of the transfer arm 25 is uniquely configured and has a precise geometry to cooperate with a safety lever 40 and a second stage sear 42. The transfer arm 25 defines an intermediate cavity 45 configured for receipt of a safety lever flange 48. The intermediate cavity 45 defines a first contact 50 configured to selectively receive and mate with the safety lever flange 48. The transfer arm 25 defines a front cavity 52 configured to receive a flange 55 of the second stage sear 42. The transfer arm front cavity 52 has a novel configuration and has a precise geometry corresponding to the second stage sear flange 55 as shown. Thus, when the transfer arm 25 rotates counterclockwise, about pin 34, the front cavity 52 engages with the second stage sear flange 55 to limit movement as explained more fully below.

The safety lever 40 provides added security to the trigger mechanism 10. The safety lever 40 is mounted to the plate element 18 by a pin 54 upon which it is pivotally mounted. The plate element 18 also includes a safety lever stop 56 to limit rotational movement of the safety lever 40. The top end of the safety lever 40 includes a flange 48 for cooperating with the intermediate cavity 45 of the transfer arm 25. The bottom end of the safety lever 40 defines an arm 40 configured for receipt and to cooperate with a top cavity 60 of bottom sear 62. Rotational movement of the safety lever 40 is limited by the stop 56, interaction with the transfer arm 25 and the bottom sear 62 as described below.

The second stage sear 42 defines an intermediate cavity 65 sized and configured to receive and engage a bottom, front flange 51 of the transfer arm 25. The second stage sear 42 includes the flange 55 having a novel geometry corresponding to the geometry of the front cavity 52 of the transfer arm 25. The second stage sear 42 defines a top cavity 66 sized and configured to receive and cooperate with a downwardly extending flange 67 of the transfer arm 25. The second stage sear 42 defines a front arm 68 configured to cooperate with a second stage spring 70. Accordingly, the second stage sear 42 is biased by the spring 70 upward, so as to rotate in a clockwise direction about the center of rotation provided by the pin 72 which pivotally connects the second stage sear 42 to the plate element 18. A stop 74 extending from the plate element 18 limits counter-clockwise rotation of the second stage sear 42.

The second stage spring 70 comprises predetermined coil dimensions to apply predetermined spring forces onto the second stage sear 42. The length of the spring 70 is selected so as to enable fine tuning of the preferred trigger pull resistance based on the user's preferences. The length of the spring 70 provides for an increase in spring tension at a slower rate. Tension of the spring is adjusted by a set screw 75 which is received by the trigger mechanism 10 body to exert pressure on the spring 70 directly or, as shown, onto a ball bearing 76. Ball bearing 76 provides for an effective interface between the set screw 75 and the spring 70 and provides for a better contact surface therebetween. Ball bearing 76 also provides for smoother contact and prevents clicking noises.

The bottom sear 62 is sized, configured and weighted to cooperate with safety lever 40, the plate element 18, a first stage spring 78, and the trigger 12. The bottom sear 62 is rotatably connected to the plate element 18 by a pin 80. The bottom sear 62 defines a top arm or flange 82 which is configured to cooperate with the safety lever 40. The bottom sear 62 defines a top cavity 60 sized and configured for receipt of the bottom arm 58 of the safety lever 40. A back arm 85 of the bottom sear 62 engages a stop 86 of the plate element 18. A second stop 88 is also provided. A bottom contact 90 engages the first stage spring 78. As shown, a ball bearing 76 is also provided with the first stage spring 78. The first stage spring 78 is also selected with a predetermined coil length and coil forces to apply the appropriate forces onto the bottom sear 62 so as to bias the bottom sear 62 to rotate about its axis of rotation, about pin 80 in a clockwise direction. The bottom sear 62 also comprises a bottom arm 92 which is configured to cooperate with the trigger 12. More specifically, the trigger 12 upper portion defines a channel 13 configured for slidable receipt of the arm 92. Accordingly, by use of an adjustment member 95, the trigger 12 may slide along the length of the arm 92 and is secured in place to obtain the desired trigger 12 position and pull length. The trigger 12 defines a trigger shoe 96 configured for receipt of the user's firing finger.

The trigger mechanism 10 according to the present invention provides a single trigger mechanism 10 which provides a single-stage trigger operation and a two-stage trigger mechanism which provides a two-stage operation. This is achieved, in part, by the novel cooperation of the various trigger mechanism 10 components. The desired single-stage or two-stage operation is achieved by a stage selector pin 100 which is selectively positioned in either a single stage pin aperture 102 or double stage pin aperture 104. Alternatively, no double stage aperture 104 is provided and the pin 100 is merely removed and stored separate from the plate element 18.

Figure 3:
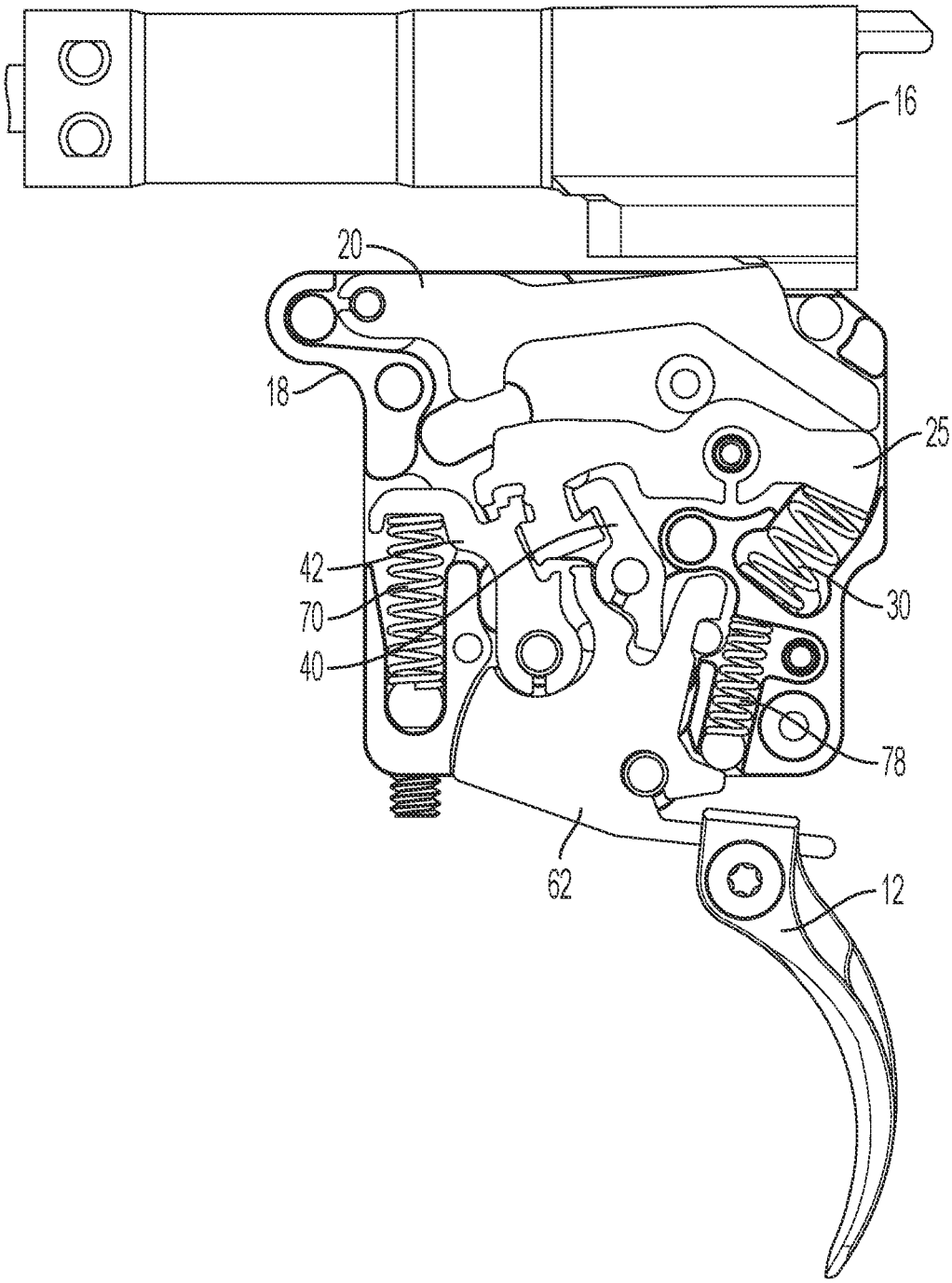
FIG. 3 is a front, elevation view thereof.
Figure 4:
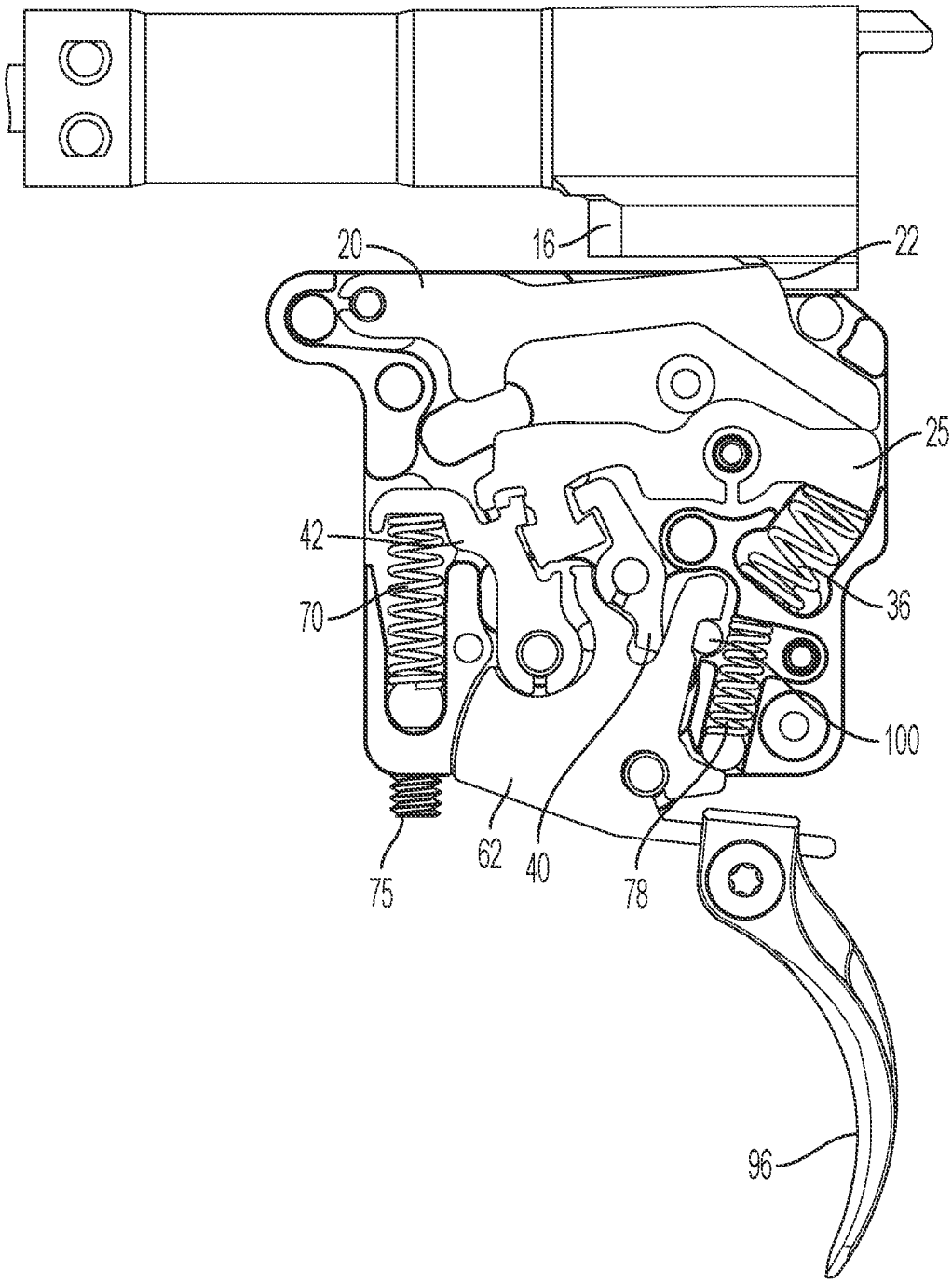
FIG. 4 is a front elevation view of the initial position of the trigger mechanism with a two-stage operation.
Figure 8:
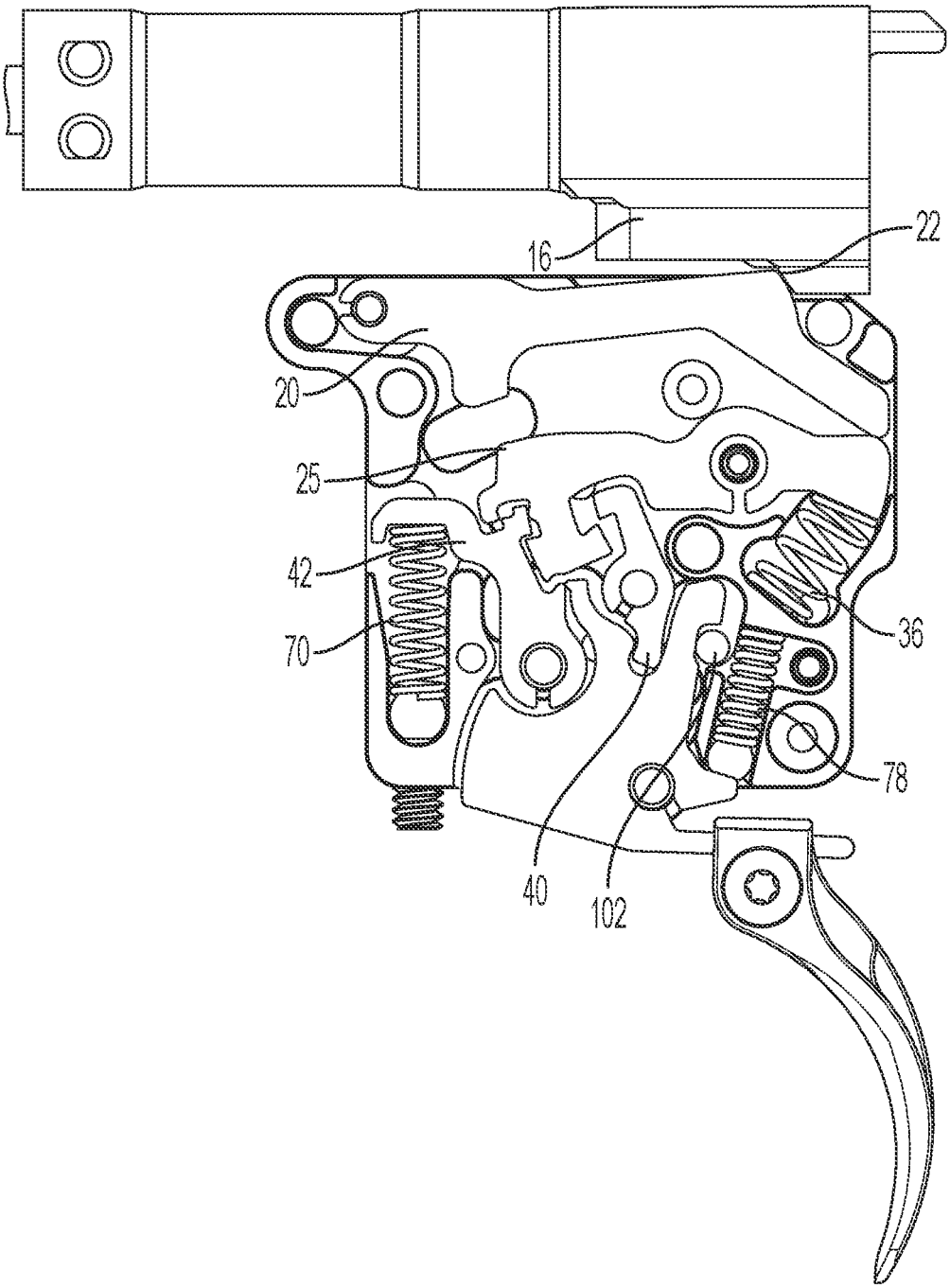
FIG. 8 is a front elevation view of the initial position of the trigger mechanism with a single-stage operation.
Figure 9:
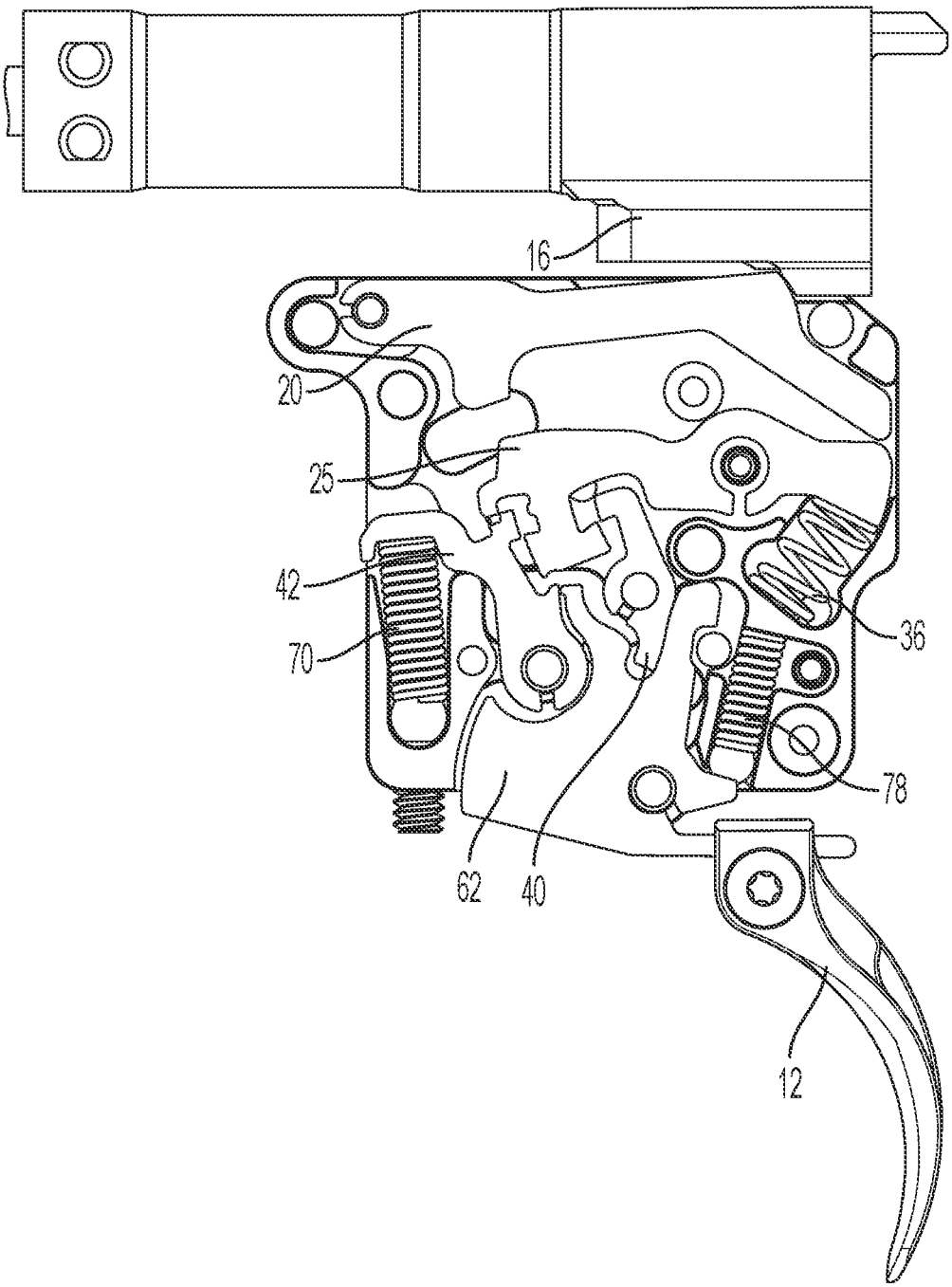
FIG. 9 is a front elevation view of an intermediate position of the trigger mechanism of FIG. 8.
Figure 10:
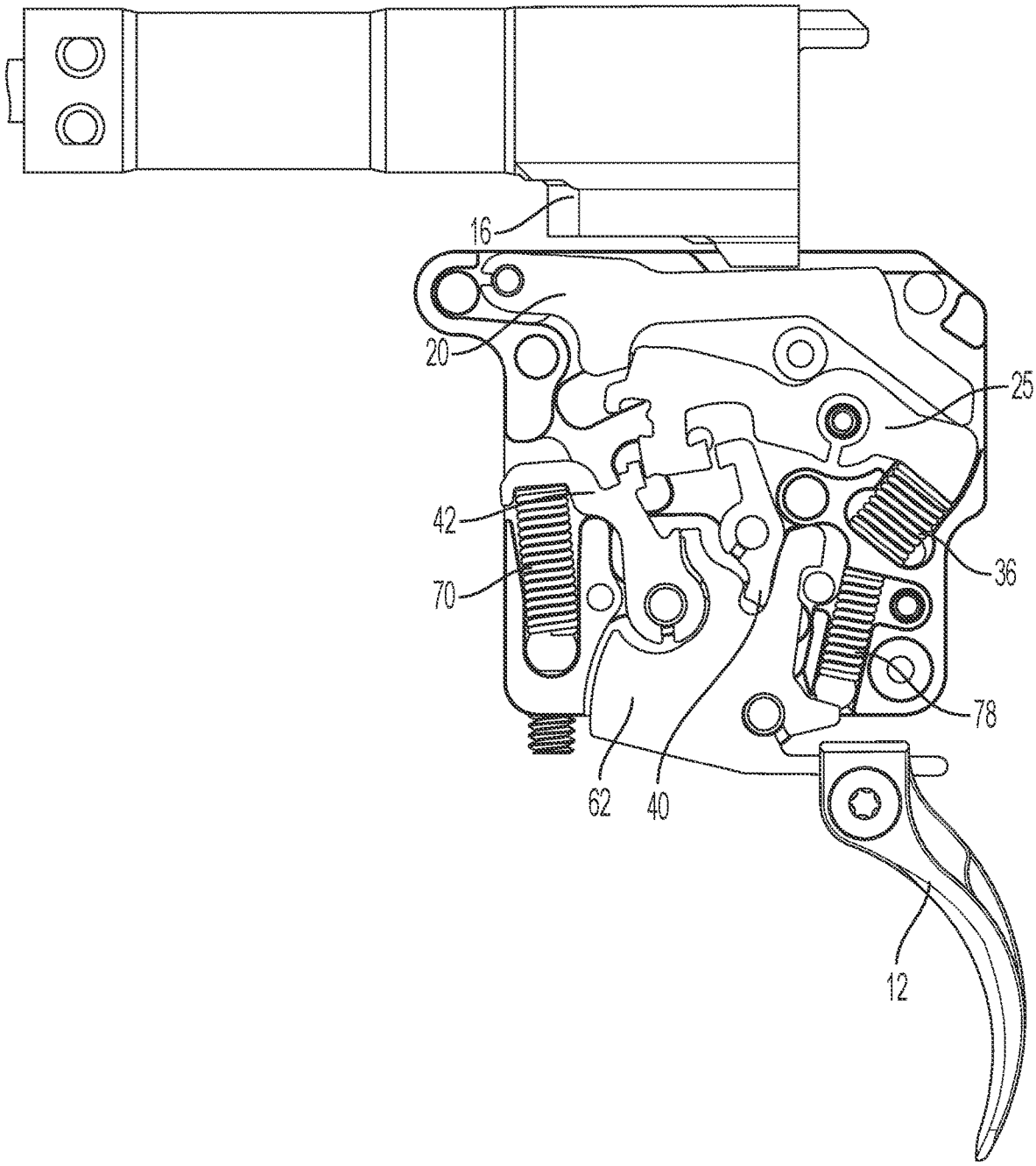
FIG. 10 is a front elevation view of FIGS. 8 and 9 in the to-be fired position.

The operation of the trigger mechanism 18 will now be described in more detail with reference to FIGS. 4-10. FIGS. 4-7 illustrate the two-stage operation and FIGS. 8-10 illustrate the single-stage operation. FIGS. 3 and 4 show the stage selector pin 100 in the double-stage pin aperture 104. As shown in FIG. 4, in the initial position, no load is applied to the trigger and the rifle is cocked, the top sear top contact 22 engages the cocking piece 16, thereby preventing the coking piece 16 from moving forward and firing (firing pin space is blocked). In the initial position, the safety lever 40 is engaged with the transfer arm 25 and bottom sear 62 and rotation of the safety lever 40 is precluded. Similarly, the second stage sear 42 is precluded from rotating as it engages the transfer arm 25. The second stage spring 70 is not compressed and, thus, biases the second stage sear 42 against the transfer arm 25 while the second stage sear 42 does not engage the bottom sear 62. In this initial position, the springs 36, 70 or 78 are not compressed.

Figure 5:
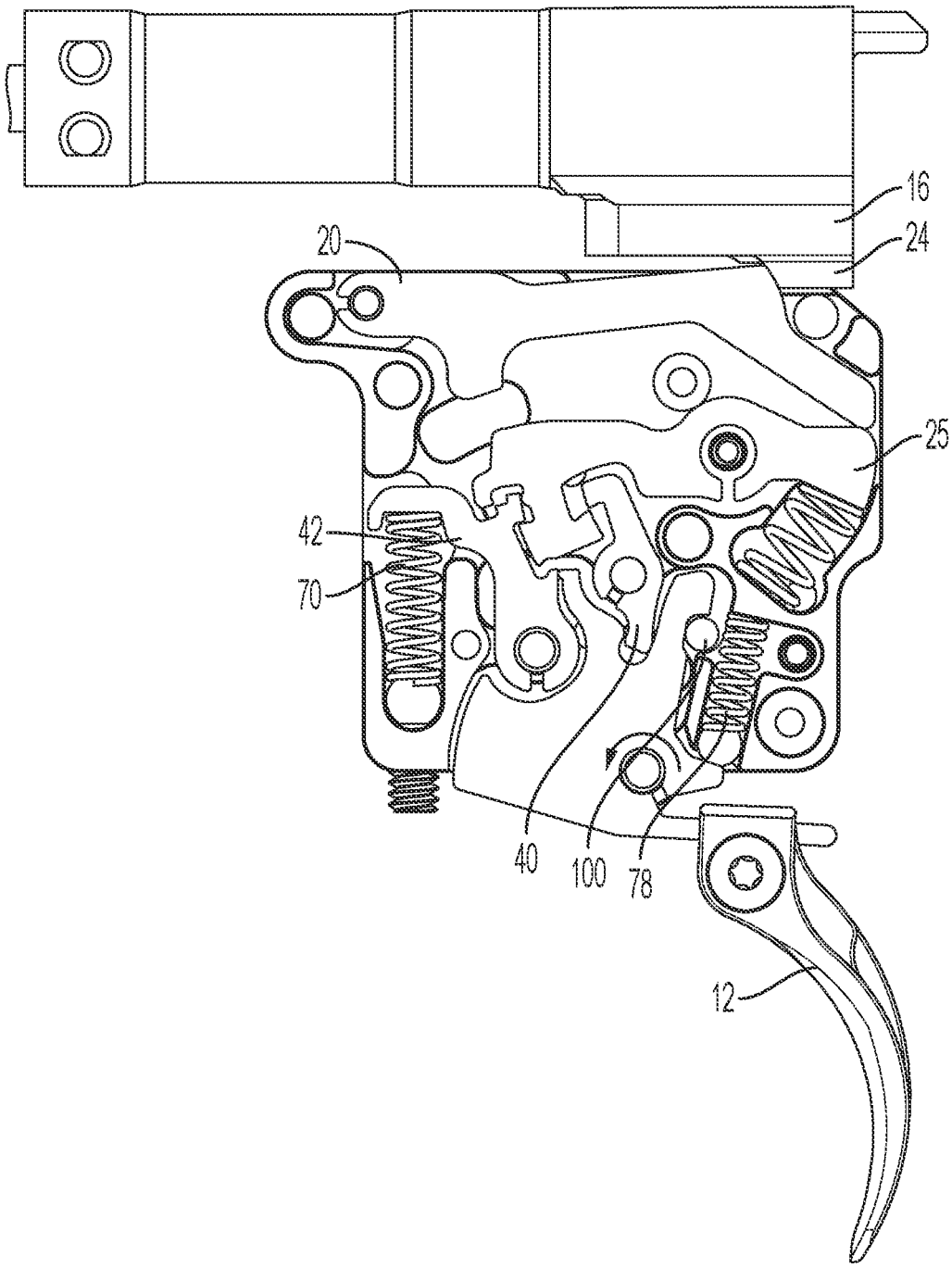
FIG. 5 is a front elevation view of an intermediate position of the trigger mechanism of FIG. 4.

As shown in FIG. 5, partial load is applied to the trigger 12 and the first of the two-stage operation is engaged wherein the cocking piece 16 remains in contact with the top contact 22 of the top sear 20 and firing is precluded. In the first stage of operation, the safety lever 40 disengages from the transfer arm 25 and rotates in the clockwise direction. The first stage spring 78 is partially compressed by the bottom sear bottom contact 90 wherein the bottom sear 62 rotates in a counter clockwise direction. This rotation engages the top arm 82 of the bottom sear 62 with the second stage sear 42, causing rotation of the second stage sear 42 in a counter clockwise direction. The second state sear front arm 68 does not yet compress the second stage spring 70 in this first stage of the two-stage operation. The second stage sear 42 continuous to engage the transfer arm 25 via the second stage sear flange 55 received within the front cavity 52 of the transfer arm 25. The trigger activation needed to effectuate the trigger mechanism 12 during this first stage of a two-stage operation will be previously set by the user and typically an easier trigger pull/lighter trigger weight will be set, compared to that of the second stage.

Figure 6:
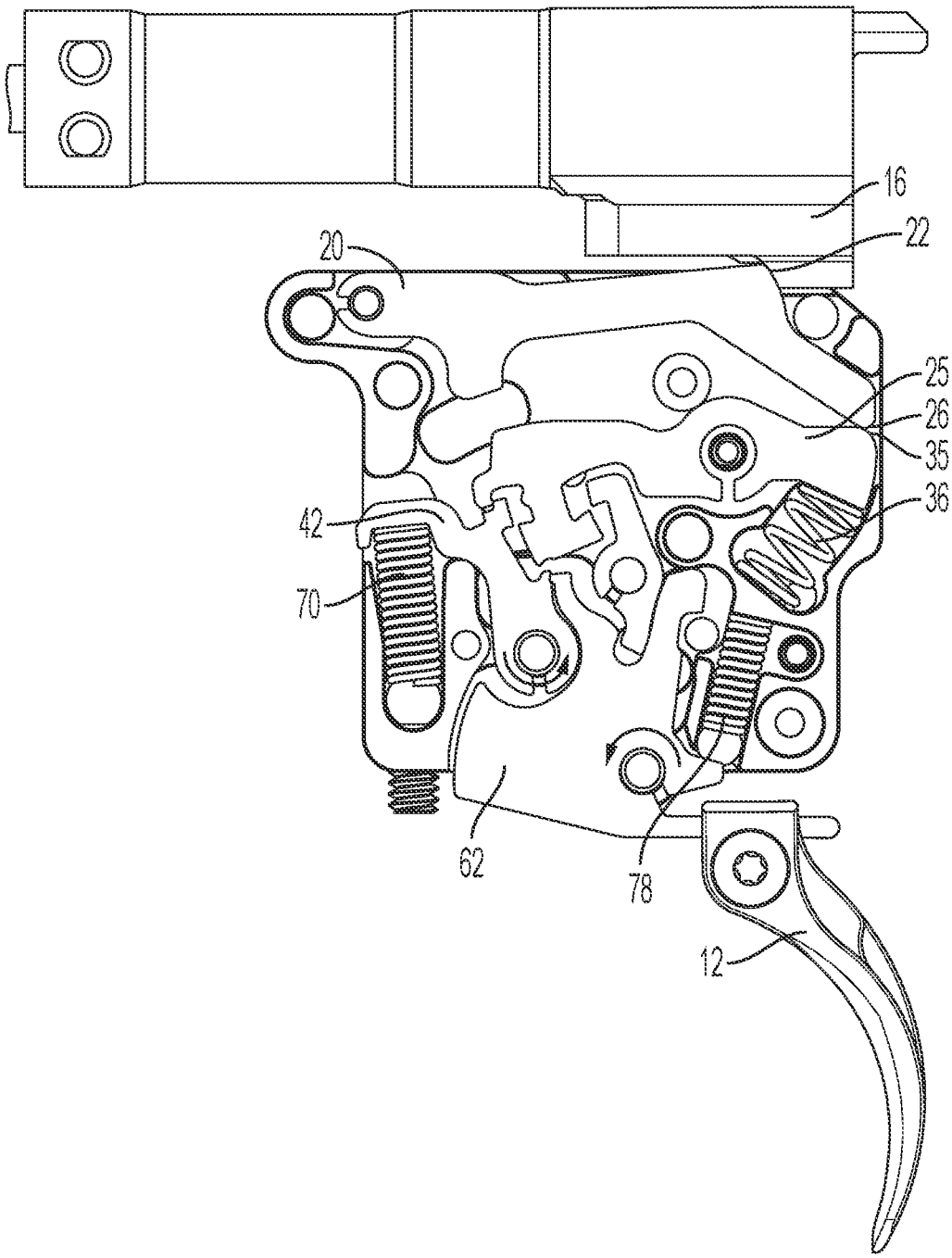
FIG. 6 is a front elevation view of FIG. 5 in the sequential position.

FIG. 6 illustrates the trigger mechanism 12 in the second stage of the two-stage operation just prior to firing. Additional load is applied to the trigger 12, for example, with forces applied to the trigger 12 greater than forces applied in the first stage of the two-stage operation. The cocking piece 16 is free to move forward wherein the top sear 20 rotates clockwise and the top sear contact 22 lowers, vacating the firing pin space. The top sear back contact 26 engage the back contact point 35 of the transfer arm 25, causing it to compress fully the reset spring 36. As a result, the front of the transfer arm 25 rotates clockwise and the transfer arm first contact 50 disengages from the safety lever flange 48. The safety lever 40 rotates in a clockwise direction as the transfer arm 25 and bottom sear 62 rotate about respective axes. The transfer arm 25 engages second stage sear 42 which rotates counter-clockwise and the front arm 68 compresses the second stage spring 70. The bottom sear 62 likewise is engaged with the second stage sear 42, further applying forces impacting rotation. The additional trigger forces required to pull the trigger 12 are achieved by the involvement of second stage spring 70 which was not involved in the operation of the first stage.

Figure 7:
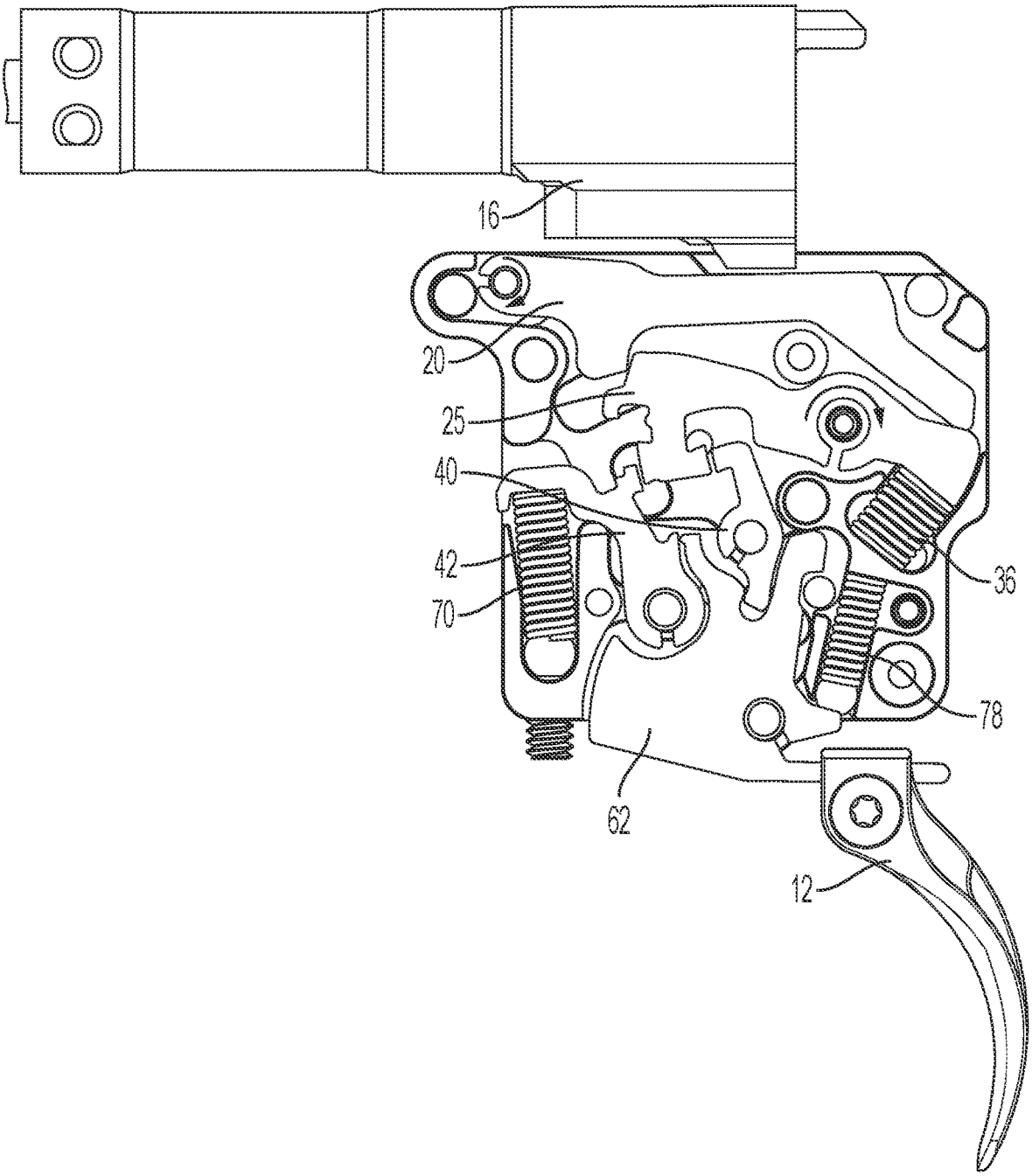
FIG. 7 is a front elevation view of FIGS. 4-6 in the to-be fired position.

FIG. 7 illustrates the firing position of the trigger mechanism 12, when full load is applied to the trigger and the reset spring 36 is fully compressed. The safety lever 40 is disengaged and free to rotate and the transfer arm 25 rotates clockwise. The second stage sear 70 is disengaged from the transfer arm 25 and the second stage sear 42 fully compresses the second stage spring 70. The second stage sear 42 engages the bottom sear 62 as shown. Upon firing, the reset spring 36 is released and the trigger mechanism components return to original position.

FIG. 8 illustrates the initial position of the single stage operation of the trigger mechanism 12 wherein the stage selector pin 100 is removed from second stage pin aperture 104 and positioned in the single stage pin aperture 102 and pushes the bottom sear 62 against the second stage sear 42. In this initial position, the cocking piece 16 and top sear 20 are engaged and the cocking piece 20 is prevented from movement. The safety lever 40 is not engaged in the initial position of the single state operation. The second stage sear 42 engages the transfer arm 25 and the bottom sear 62. The reset spring 36 and the second stage spring 70 are not compressed while the first stage spring 78 is partially compressed.

FIG. 9 illustrates the trigger mechanism 12 when a full load is applied to the trigger 12 by the user, prior to firing. The cocking piece 16 remains in contact with the top sear 20, the safety lever 40 remains disengaged, the reset spring 36 remains non-compressed. However, the first stage spring 78 is fully compressed. The second stage sear 42 disengages from the transfer arm 25, thus compressing the second stage spring 70 and contacting the bottom sear 62.

FIG. 10 illustrates the firing position for the single-stage operation trigger mechanism 12. The cocking piece 16 moves forward so as to no longer contact the top sear 20. The safety lever 40 remains disengaged. The first stage spring 78 and second stage spring 70 are now fully compressed, the second stage sear 42 engages the bottom sear 62 and the second stage sear 42 disengages from the transfer arm 25 to compress the second stage spring 70.

The trigger mechanism 12 as shown and described includes numerous components which, it is believed, permit more precise tuning of the trigger mechanism 12 to achieve precise user preferences. Moreover, safety of the firearm results due to the unique geometries of parts, such as the second stage sear flange 55 encapsulated within the front cavity 52 of the transfer arm 25. Moreover, the selected masses of the individual components are selected to provide the selected counter-balances to further increase the safety of the firearm and prevent unintentional firing when the firearm is hit (for example, dropped) on any side. The preferred center of gravity is about center of gravity point X shown in FIG. 1. This further prevents accidental firing such as when the firearm is knocked form the back. Security is also enhanced by the safety lever 40 which, due to gravity, will not permit firing if, for example, the barrel is hit. It only releases when the trigger 12 is pulled.

While exemplary embodiments have been shown and described above for the purpose of disclosure, modifications to the disclosed embodiments may occur to those skilled in the art. The disclosure, therefore, is not limited to the above precise embodiments and that changes may be made without departing from its spirit and scope.

What is claimed is:

1. A trigger mechanism for a firearm comprising:

at least one plate element having a front, a back, a top and a bottom;

a top sear pivotally mounted to said at least one plate element about a top sear pivot point and extending substantially along said top of said at least one plate element, said top sear including a back portion which is biased upward to prevent firing, wherein said top sear is biased in a counterclockwise direction;

a transfer arm pivotally mounted to said at least one plate element about a transfer arm pivot point positioned below said top sear pivot point, said transfer arm having a back portion biased upward so as to urge said back portion of said top sear upward, and wherein said transfer arm has a front portion and a bottom portion;

a safety lever pivotally mounted to said at least one plate element about a safety lever pivot point positioned below said transfer arm pivot point, said safety lever has a top end configured to cooperate with said bottom portion of said transfer arm, and wherein said safety lever has a bottom end;

a second stage sear pivotally mounted to said at least one plate element about a second stage sear pivot point positioned below said transfer arm pivot point, said second stage sear having a top member configured to cooperate with said front portion of said transfer arm, and wherein said second stage sear is biased in a clockwise direction so as to engage said transfer arm;

a trigger extending below said at least one plate element;

a bottom sear pivotally mounted to said at least one plate element about a bottom sear pivot point, wherein a top portion of said bottom sear cooperates with said bottom end of the safety lever and said second stage sear, and wherein a bottom portion of said bottom sear is operatively connected to said trigger; and a first stage spring positioned to bias said bottom sear about said bottom sear pivot point in the clockwise direction.

2. The trigger mechanism according to claim 1 further comprising a second stage spring positioned adjacent said second stage sear to bias said second stage sear in the clockwise direction.

3. The trigger mechanism according to claim 2 wherein said trigger is moveable between a first stage operation position wherein said trigger is under partial load, and a second stage operation position wherein said trigger is under additional load, and wherein in said first stage operation position, said safety lever disengages from said transfer arm and said first stage spring is partially compressed by said bottom portion of said bottom sear, and wherein in said second stage operation position, said transfer arm disengages from said safety lever and said second stage spring is compressed.

4. The trigger mechanism according to claim 3 wherein a first force is applied to said trigger in said first stage operation position and a second forced is applied to said trigger in said second stage operation position, and wherein said second force is greater than said first force.

5. The trigger mechanism according to claim 2 wherein said at least one plate element defines a first aperture and a second aperture and said trigger mechanism further comprises a stage selector pin which is selectively positioned in said second aperture to facilitate a double stage operation.

6. The trigger mechanism according to claim 1 wherein said trigger mechanism has a center of gravity located on said bottom sear.

7. The trigger mechanism according to claim 1 wherein said trigger mechanism has a trigger housing and said trigger extends below said trigger housing.

8. The trigger mechanism according to claim 1 wherein said at least one plate element includes a stop adjacent said front and said top of the at least one plate element for cooperating with said top sear to limit counterclockwise rotation of said top sear.

9. The trigger mechanism according to claim 1 wherein said front portion of the transfer arm defines a transfer arm front cavity and said second stage sear includes a flange configured to be received by said transfer arm front cavity.

10. The trigger mechanism according to claim 1 wherein said top end of the safety lever defines a flange configured to be received by a cavity defined by said bottom portion of the transfer arm.

11. The trigger mechanism according to claim 1 wherein said top sear comprises a first contact point configured for preventing firing and a second contact point for cooperating with said transfer arm.

12. The trigger mechanism according to claim 1 further comprising a reset spring, wherein said transfer arm is upwardly biased by said reset spring which is operatively associated with said back portion of the transfer arm.

13. The trigger mechanism according to claim 1 wherein said at least one plate member includes a safety lever stop positioned adjacent a safety limit to limit rotations movement of said safety lever.

14. The trigger mechanism according to claim 1 wherein said top member of the second stage sear is an intermediate cavity and said transfer arm front portion further includes a front flange configured to cooperate with said second stage sear intermediate cavity.

15. The trigger mechanism according to claim 1 further comprising a second stage spring positioned on said at least one plate element so as to bias said second stage sear in said clockwise direction.

16. The trigger mechanism according to claim 15 wherein said second stage sear includes a front arm configured to cooperate with said second stage spring.

17. The trigger mechanism according to claim 15 wherein said second stage spring has an adjustable tension.

18. The trigger mechanism according to claim 17 further comprising a set screw which is adjusted to exert selective forces on said second stage spring.

19. The trigger mechanism according to claim 18 further comprising a ball bearing positioned between said set screw and said second stage spring.

20. The trigger mechanism according to claim 1 wherein said bottom sear includes a top arm configured to cooperate with said safety lever.

21. The trigger mechanism according to claim 1 wherein said top portion of the bottom sear defines a top cavity configured to cooperate with said bottom end of the safety lever.

22. The trigger mechanism according to claim 1 wherein said bottom sear comprises a bottom arm and said trigger comprises an upper portion channel configured for slidable receipt of said bottom arm of the bottom sear.

23. The trigger mechanism according to claim 1 further comprising an adjustment member for securing said bottom arm of the bottom sear in said trigger channel to provide an adjustable trigger length.

24. A trigger mechanism for a firearm comprising:

at least one plate element having a front, a back, a top and a bottom;

a top sear pivotally mounted to a said at least one plate element about a top sear pivot point and extending substantially along said top of said at least one plate element, said top sear being configured wherein a back portion of said top sear is biased upward to prevent firing, wherein said top sear is biased in a counterclockwise direction;

a transfer arm pivotally mounted to said at least one plate element about a transfer arm pivot point positioned below said top sear pivot point, said transfer arm having a back portion biased upward absent application of a force so as to urge said back portion of said top sear upward, and wherein said transfer arm has a front portion and a bottom portion;

a second stage sear pivotally mounted to said at least one plate element about a second stage sear pivot point positioned below said transfer arm pivot point, said second stage sear having a top member configured to cooperate with said front portion of said transfer arm, and wherein said second stage sear is biased in a clockwise direction so as to engage said transfer arm with trigger extending below said at least one plate element;

a bottom sear pivotally mounted to said at least one plate element about a bottom sear pivot point positioned below said second stage sear pivot point, wherein a top portion of said bottom sear cooperates with said second stage sear and a bottom portion of said bottom sear is operatively connected to said trigger;

a first stage spring positioned to bias said bottom sear about said bottom sear pivot point in the clockwise direction; and a second stage spring positioned on said at least one plate element so as to bias said second stage sear in said clockwise direction.

25. The trigger mechanism according to claim 24 wherein said trigger is moveable between a first position wherein said trigger is substantially under no load, a first stage operation position wherein said trigger is under partial load, and a second stage operation position wherein said trigger is under additional load, wherein in said first stage operation position, said first stage spring is partially compressed by said bottom portion of said bottom sear, and wherein in said second stage operation position said transfer arm disengages from said safety lever and said second stage spring is compressed.

26. The trigger mechanism according to claim 25 wherein a first forced is applied in said first stage operation position and a second forced is applied in said second stage operation position, wherein said second force is greater than said first force.

27. The trigger mechanism according to claim 24 wherein said at least one plate element defines a first aperture and a second aperture and said trigger mechanism comprises a stage selector pin which is selectively positioned in said second aperture to facilitate a double stage operation.

* * * * *